United States Patent [19]

De Varennes

[11] Patent Number: 4,765,130

[45] Date of Patent: Aug. 23, 1988

[54] METHOD AND APPARATUS FOR MAKING CABLE CORE

[75] Inventor: Joseph G. C. C. De Varennes, Montreal, Canada

[73] Assignee: Northern Telecom Limited, Montreal, Canada

[21] Appl. No.: 115,323

[22] Filed: Nov. 2, 1987

[51] Int. Cl.[4] ..... D07B 1/06

[52] U.S. Cl. ..... 57/59; 57/9; 57/311; 57/138

[58] Field of Search ..... 57/9, 59, 309, 311, 57/65

[56] References Cited

U.S. PATENT DOCUMENTS

| | | | |
|---|---|---|---|
| 1,691,103 | 11/1928 | Yancey | 57/138 |
| 2,122,911 | 7/1938 | Hunter et al. | 57/9 |
| 3,130,536 | 4/1964 | Peterson et al. | 57/9 |
| 3,382,314 | 5/1968 | Norblad | 57/59 X |
| 3,457,718 | 7/1969 | Otto et al. | 57/9 |
| 4,270,341 | 6/1981 | Glushko et al. | 57/311 X |

*Primary Examiner*—Donald Watkins

*Attorney, Agent, or Firm*—R. J. Austin; C. W. Junkin

[57] ABSTRACT

In a method and apparatus for making a cable core, cable core units are stranded together while drawing the cable core units along a passline through a closing die and while vibrating the closing die. Vibration of the closing die facilitates movement of insulated conductors of the cable core units over one another to provide a greater and more uniform packing density of conductors in the resulting cable core.

8 Claims, 3 Drawing Sheets

METHOD AND APPARATUS FOR MAKING CABLE CORE

The present invention relates to a method and apparatus for making a cable core.

Telecommunications cable cores are typically made by stranding together a plurality of cable core units, each of which may comprise one or more twisted together pairs of insulated conductors. For example, a typical 3600 pair cable is made by stranding together 36 cable core units, each of which comprises 100 individually twisted pairs of insulated conductors stranded together to form a 100 pair cable core unit.

The cable core units are passed through a closing die during the stranding operation to ensure that the resulting cable core has a uniform diameter and shape. Unfortunately, some insulated conductors (e.g. pulp or plastic insulated conductors) do not readily slide over one another during the stranding operation and this limits the minimum size of closing die that can be used. Consequently, the resulting cable core diameter may be larger than is desired. Moreover, because the insulated conductors do not readily slide over one another the packing density of the conductors may be non-uniform, and this results in non-uniform electrical characteristics of the cable cores. Similar problems are encountered when stranding together pairs of twisted insulated conductors to form the cable core units.

The present invention seeks to provide a method and apparatus for making a cable core which provides a smaller and more uniformly packed cable core.

According to one aspect of the present invention, there is provided a method of making a cable core structure, comprising stranding together a plurality of cable core structure forming elements while drawing the cable core structure forming elements along a passline through a closing die, and simultaneously vibrating the closing die to compact the stranded elements together.

In the above method according to the invention and as referred to elsewhere throughout this specification including the claims, the term "cable core structure forming element" includes an individual pair of twisted together insulated wires or a plurality of such pairs stranded together to form a cable core unit. The term "cable core structure" includes such a cable core unit or a plurality of such cable core units stranded together, either of which structures may be used as a cable core.

According to another aspect of the invention, there is provided apparatus for making a cable core structure, comprising a closing die for causing convergence of a plurality of cable core structure forming elements as they are passed through the die and means for vibrating the closing die.

The vibration of the closing die causes vibration of the cable core structure forming elements during the stranding operation. The vibrating cable core structure forming elements move readily over one another, allowing smaller cable core structure diameters and more uniform packing densities to be achieved.

Embodiments of the invention will now be described by way of example only, with reference to the accompanying drawings, in which.

Figure 1:
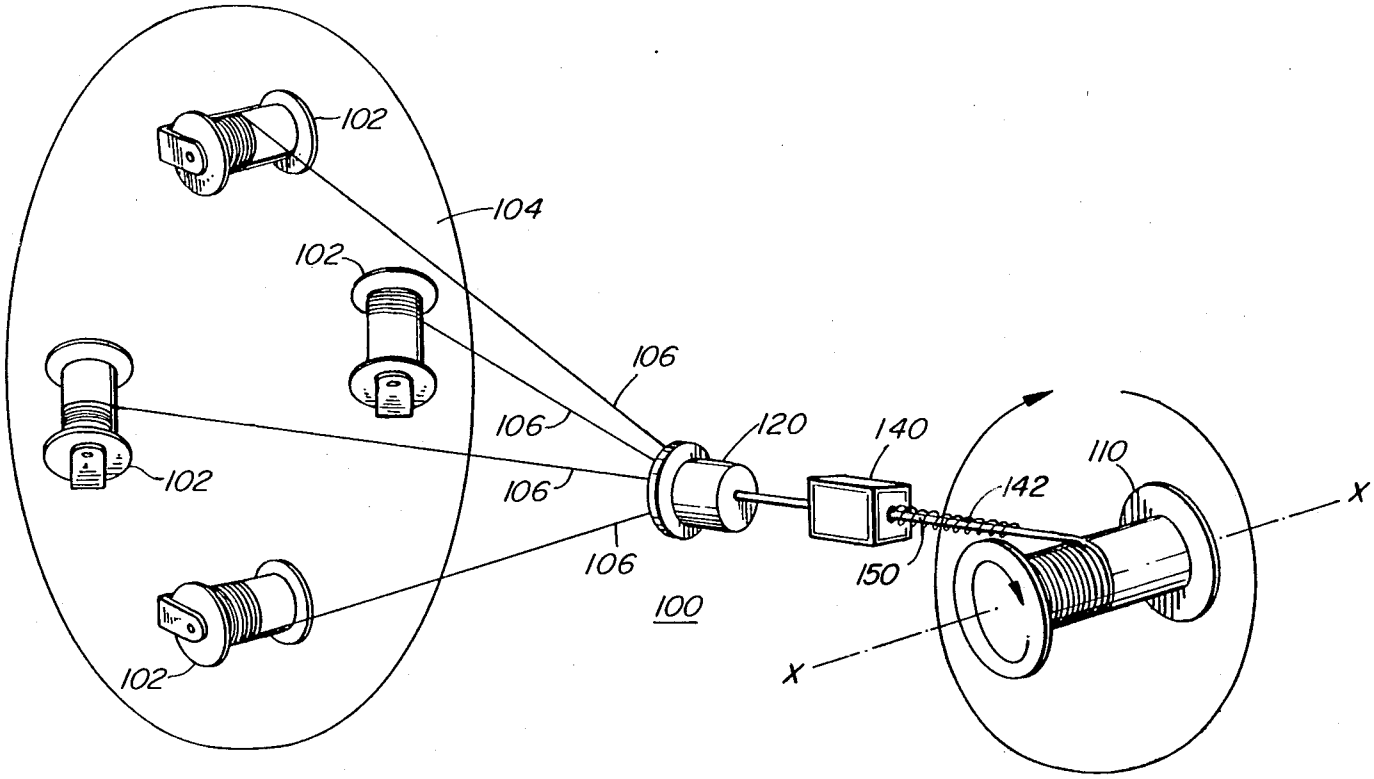
FIG. 1 is a schematic isometric view of apparatus for making a cable core according to a first embodiment.

Referring to FIG. 1, apparatus 100 for making a cable core structure, i.e. a cable core, comprises supply means in the form of four supply reels 102 mounted for rotation about their individual axes to a support 104 at positions angularly spaced around a passline. Each supply reel 102 is wound with a cable core structure forming element 106, each of which comprises 100 individually twisted pairs of pulp insulated conductor stranded together to form a 400 pair cable core unit.

Figure 3:
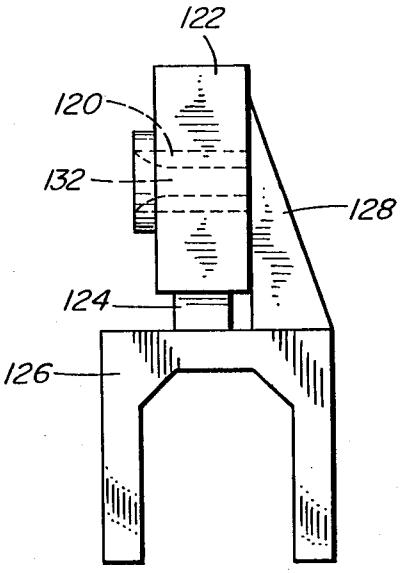
FIG. 3 is a side elevational view of the closing die and vibrating means of FIG. 2.
Figure 2:
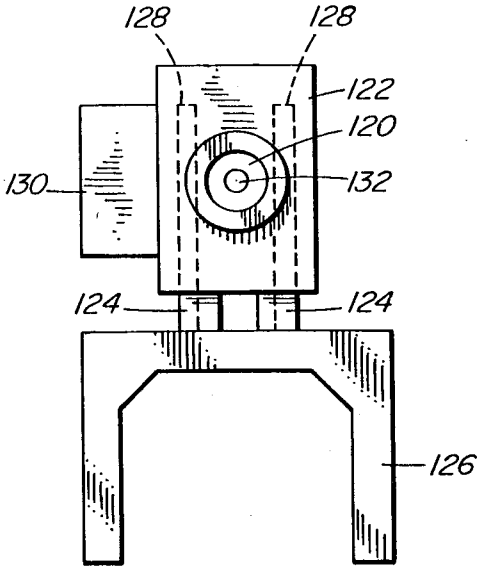
FIG. 2 is a front elevational view of a closing die and vibrating means of the apparatus of FIG. 1 taken in the direction of arrow II of FIG. 1 and showing greater detail.

The apparatus 100 also comprises a strander comprising take-up means in the form of a take-up reel 110 and means (not shown) for driving the reel 110 to rotate about its own axis X—X and simultaneously for rotating the take-up reel about the passline. Such a drive arrangement is conventional and will be discussed no further. The strander also includes a closing die 120. The closing die 120 and its mounting are shown in greater detail in FIGS. 2 and 3. The die 120 is fixed within a block 122 which is mounted on resilient pads 124 fixed to a rigid support 126. A pair of brackets 128 are fixed to the support 126 and bear against a rear surface of the block 122 at positions spaced laterally of the passline to hold the block and die on the passline. Vibrating means in the form of a vibrator 130 is fixed to the block 122. The die 120 has a passage 132 which tapers along the passline. Downstream of the closing die 120 and upstream of the take-up reel 110, a conventional binder applicator 140 is provided.

In use of the apparatus 100, the cable core units 106 are fed from the supply reels, converge at the die passage 132 and then move along the passline through the binder applicator 140, to the take-up reel 110. The take-up reel 110 is driven into rotation about its own axis X—X to the passline to draw the cable core units 106 from the supply reels and through the die 120 while being driven into rotation about the passline to strand the cable core units together, thereby forming a 400 pair cable core 190 which is wound onto the take-up reel 110. The binder applicator 140 applies a binder 142 to the cable core 150.

The vibrator 130 is energized to vibrate the block 122 and die 120 in a plane normal to the passline on the resilient pads 124 as the cable core units are drawn through the die passage 132. The vibration has an amplitude of approximately ±1 millimeter at a frequency between 200 Hertz and 2000 Hertz. The vibration of the forming die 120 causes vibration of the cable core units as they are brought together within the die. The vibrating cable core units move readily over one another, compacting the cable core units together.

Figure 4:
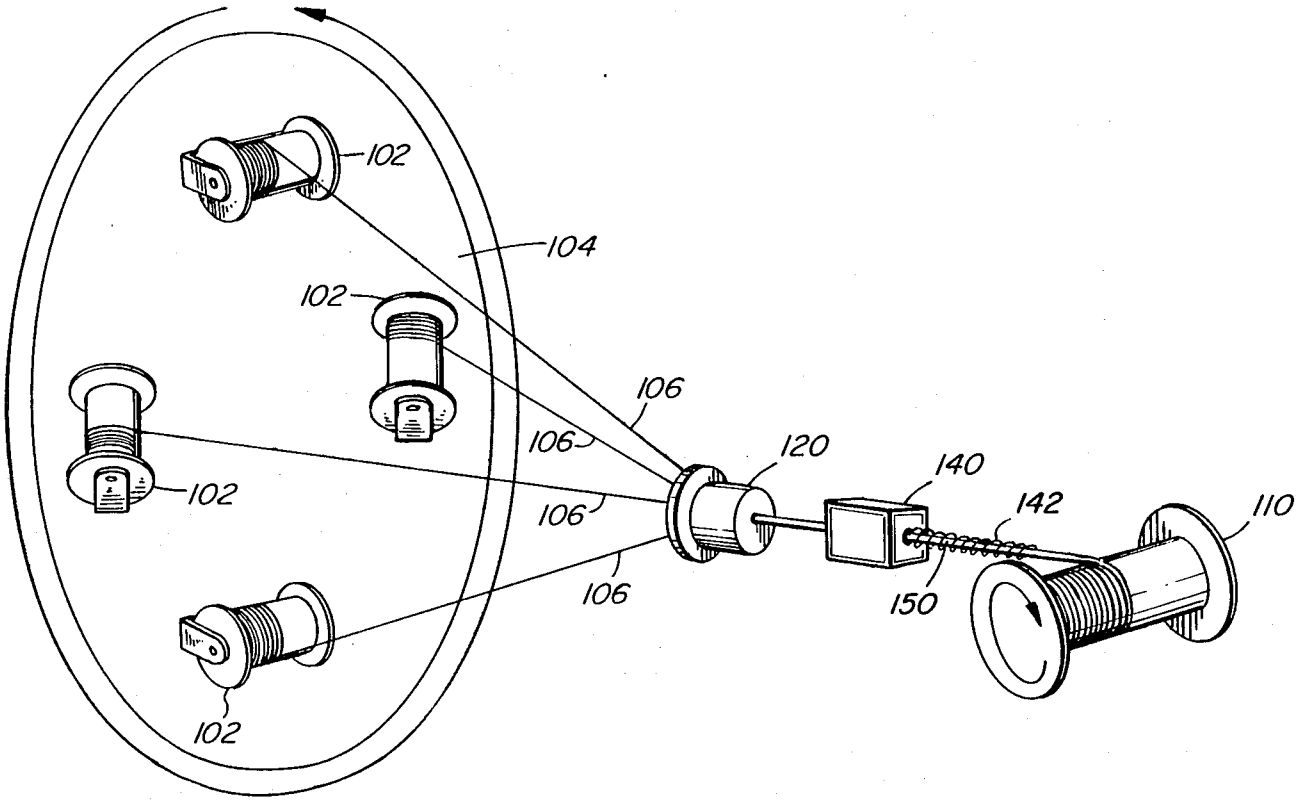
FIG. 4 is a schematic isometric view similar to FIG. 1 of apparatus for making a cable core according to a second embodiment.

In an alternative embodiment, shown in FIG. 4, the cable core units are stranded together by rotating the supply reel support 104 about the passline instead of rotating the take-up reel 110 about the passline.

In modifications of the above embodiments, each structure forming element is a single twisted together pair of insulated conductors and the cable core structure wound onto reel 110 is a core unit which may be used subsequently as a complete cable core, or may be stranded together with other cable core units into a cable core. Thus, in making each cable core unit, the conductor pairs are compacted together by vibrating means as they move through a closing die, and the resulting cable core units are compacted together by vibrating means as they are formed into a cable core. The use of vibrating means at both stranding operations further decreases the overall core diameter. To produce a core unit with single twisted together pairs of conductors in the modifications, an appropriate number of reels of conductor pairs for the core unit would replace the four reels 102 of the two embodiments described above.

Use of a vibrating closing die as described above allows smaller cable core diameters and more uniform packing densities to be achieved.

What is claimed is:

1. A method of making a cable core structure, comprising stranding together a plurality of cable core structure forming elements while drawing the cable core structure forming elements along a passline through a closing die, and simultaneously vibrating the closing die to facilitate movement of the cable core structure forming elements over one another to form a compact cable core structure without permanent deformation of the cable core structure forming elements.

2. A method as defined in claim 1, wherein the cable core structure is a cable core and each structure forming element is a core unit comprising a plurality of twisted together pairs of insulated conductors, said twisted together pairs being stranded together.

3. A method as defined in claim 1, wherein the cable core structure to a cable core unit and each structure forming element comprises a pair of insulated conductors twisted together.

4. A method as defined in claim 1, wherein the closing die is held in position on the passline and vibrated in a plane which is normal to the passline.

5. A method as defined in claim 1, wherein the frequency of vibration is between 200 Hertz and 2000 Hertz, and the amplitude of vibration is approximately 1 millimeter.

6. Apparatus for making a cable core structure, comprising:

a closing die for causing convergence of a plurality of cable core structure forming elements as they are passed through the die; and means for vibrating the closing die to facilitate movement of the cable core structure forming elements over one another to form a compact cable core structure without permanent deformation of the cable core structure forming elements.

7. Apparatus as defined in claim 6, wherein the closing die is resiliently mounted to a rigid support, and the means for vibrating comprises a vibrator operably connected to the forming die.

8. Apparatus as defined in claim 7, wherein the closing die is held in position on the passline and the vibrator operates to vibrate the die in a plane normal to the passline.

* * * * *